US005921663A

United States Patent [19]

Flammer

[11] Patent Number: 5,921,663

[45] Date of Patent: Jul. 13, 1999

[54] LAMPSHADE FOR AN OUTDOOR LIGHT, IN PARTICULAR A POLE-MOUNTED LIGHT

[75] Inventor: Eberhard Flammer, Biedenkopf, Germany

[73] Assignee: Elkamet Kunststofftechnik GmbH, Biedenkopf, Germany

[21] Appl. No.: 08/843,803

[22] Filed: Apr. 21, 1997

[30] Foreign Application Priority Data

Apr. 19, 1996 [DE] Germany ..... 296 06 988

[51] Int. Cl.[6] ..... F21V 29/00

[52] U.S. Cl. ..... 362/294; 362/431; 362/363

[58] Field of Search ..... 362/294, 226, 362/431, 414, 373, 363, 351

[56] References Cited

U.S. PATENT DOCUMENTS

| | | | |
|---|---|---|---|
| 3,679,891 | 7/1972 | Quack | 362/431 |
| 4,434,455 | 2/1984 | Merritt | 362/363 |
| 4,719,548 | 1/1988 | Orosz | 362/363 |
| 5,406,466 | 4/1995 | Stokes | 362/431 |

*Primary Examiner*—Sandra O'Shea
*Assistant Examiner*—Todd Reed Hopper
*Attorney, Agent, or Firm*—Herbert L. Lerner; Laurence A. Greenberg

[57] ABSTRACT

A street light, outdoor light or the like is mounted on a tubular pole or similar vertical holder and has a lamp socket and a bulb. A lampshade to be detachably connected to the lamp socket includes a plastic transparent bulb cover for surrounding the bulb at a given level. The bulb cover has a sharply offset zone with a cross-sectional enlargement at the given level, an upper end with a domelike bulge and a lower edge with one component of a bayonet mount for connection to the lamp socket. A sheet-metal shade ring disposed inside the bulb cover at the given level is nondisplaceably fixed in axial direction in the enlargement. A lamp canopy disposed above the bulb outside the bulb cover has a central opening through which the domelike bulge protrudes and beyond which the domelike bulge extends. A funnel-shaped metal heat shield body is disposed inside the domelike bulge and spaced apart from the bulb cover.

11 Claims, 3 Drawing Sheets

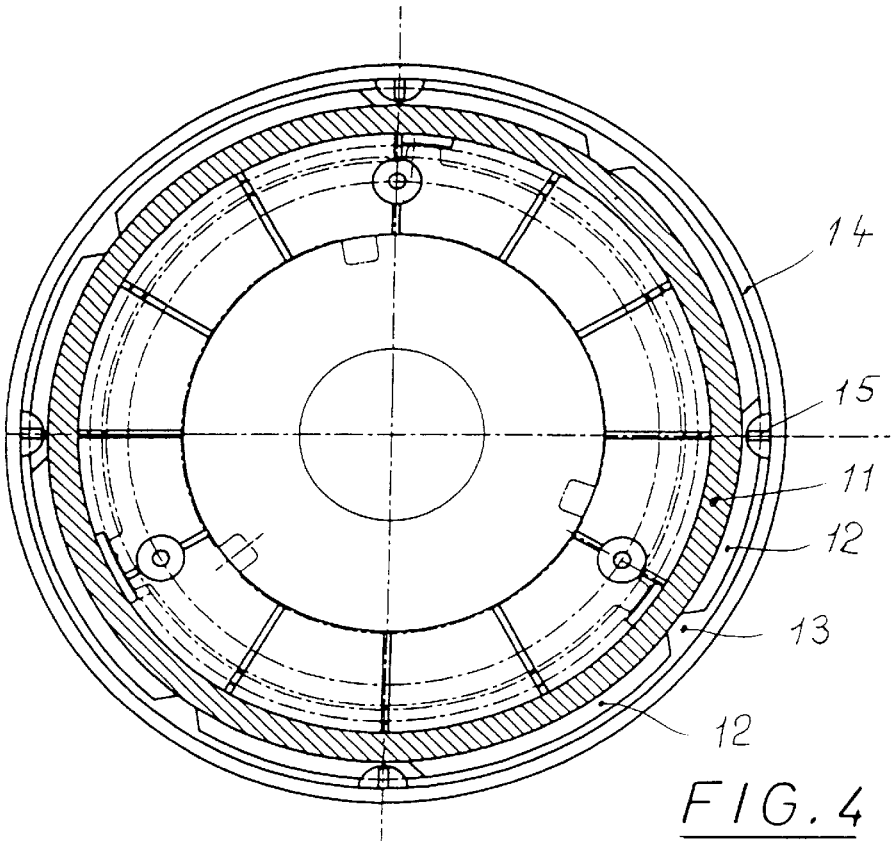
FIG. 4
FIG. 5
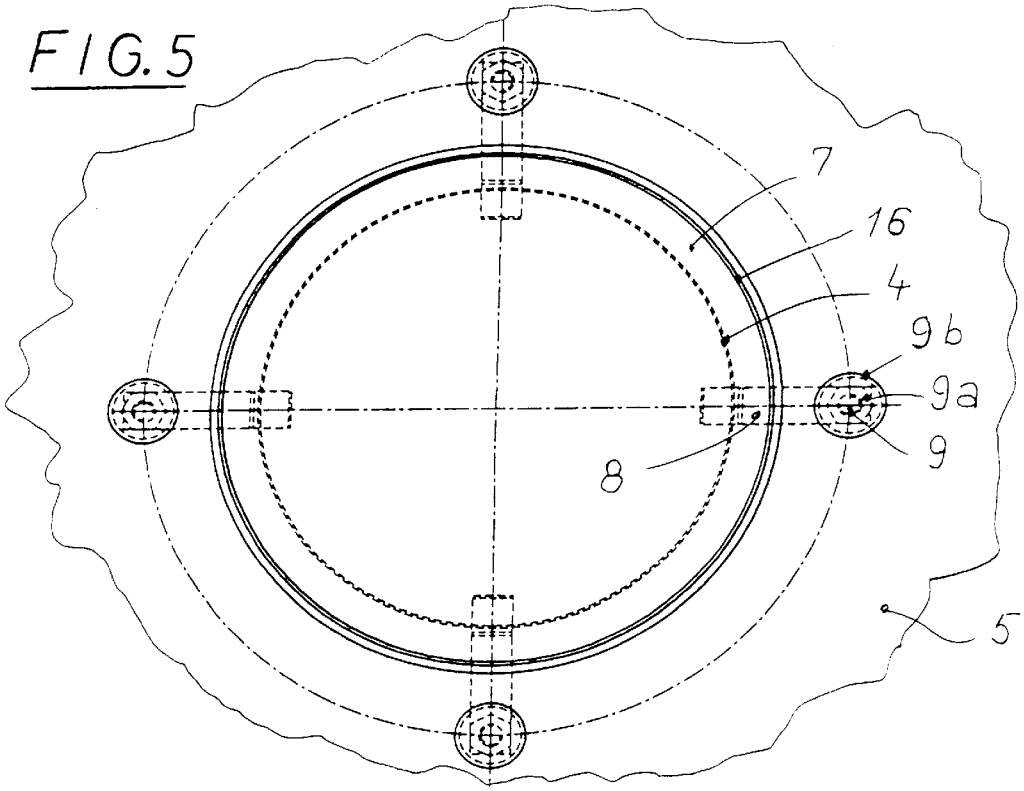

LAMPSHADE FOR AN OUTDOOR LIGHT, IN PARTICULAR A POLE-MOUNTED LIGHT

BACKGROUND OF THE INVENTION

Field of the Invention

The invention relates to a lampshade which is detachably connected to a lamp socket for street lights, outdoor lights or the like that are mounted on a tubular pole or similar vertical holder, the lampshade includes a plastic transparent bulb cover surrounding a bulb, a sheet-metal shade ring disposed inside the bulb cover at the level of the bulb, a lamp canopy which is disposed above the bulb outside the bulb cover and is penetrated in its central region by the bulb cover which protrudes beyond it, and a funnel-shaped metal heat shield body disposed inside the bulb cover in the part thereof that protrudes past the lamp canopy.

Lampshades with such features are already available on the market in various models and are therefore well known. In an advertising brochure published by the company Noral Label in Seyne-sur-Mer, France, an outdoor light with such a lampshade is offered. Similar lights are made by other companies, such as in an advertising brochure of the company Hess-Form+Licht in Villingen Schwenningen, Germany, and in a catalog put out by Hellux-Leuchten GmbH in Laatzen.

The shade ring disposed at the level of the bulb is intended to prevent blinding caused by looking directly at the bulb. In order to ensure that the shade ring does not impair the illuminating effect, the shade rings in various models are to some extent made translucent, for instance by forming them of conical annular disks with outer edges pointing downward (as in the Hellux device). The bulb is then visible only from a slight distance for one looking upward at the location of the light.

The funnel-shaped heat shield body disposed above the lamp (as in the Noral device) keeps the heat output of the lamp, which is especially oriented upward, away from that region of the lampshade.

In the Noral light, the lampshade can be removed, for instance for changing the bulb, in such a way that it can be tipped sideways with the lower part of the light through the use of a lateral pivotably connected mount.

The known lights of that type are structurally very complicated. They include many components. A great number of operations are required to produce and assemble them. As a result, such lights are very expensive even from the standpoint of the lampshade alone.

SUMMARY OF THE INVENTION

It is accordingly an object of the invention to provide a lampshade for an outdoor light, especially a pole-mounted light, which overcomes the hereinafore-mentioned disadvantages of the heretofore-known devices of this general type, which is connected to a lamp socket, which is disposed on a tubular pole or similar holder in such a way that it can be detached easily and quickly and which is structurally simpler, includes only a few individual parts, can be produced and assembled in only a few operations and is less expensive, without disadvantages in terms of illuminating effect and quality of material, than known lampshades in lights of this generic type.

With the foregoing and other objects in view there is provided, in accordance with the invention, in a street light, outdoor light or the like mounted on a tubular pole or similar vertical holder and having a lamp socket and a bulb, a lampshade to be detachably connected to the lamp socket, comprising a plastic transparent bulb cover for surrounding the bulb at a given level, the bulb cover having a sharply offset zone with a cross-sectional enlargement at the given level, an upper end with a domelike bulge, and a lower edge with one component of a bayonet mount for connection to the lamp socket; a sheet-metal shade ring disposed inside the bulb cover at the given level and nondisplaceably fixed in axial direction in the enlargement; a lamp canopy disposed above the bulb outside the bulb cover, the lamp canopy having a central opening through which the domelike bulge protrudes and beyond which the domelike bulge extends; and a funnel-shaped metal heat shield body disposed inside the domelike bulge and spaced apart from the bulb cover.

In accordance with another feature of the invention, the bulb cover is a cylindrical hollow body, the shade ring is at a given height, and the cross-sectional enlargement at the given level is a flat annular groove corresponding to the given height and receiving the shade ring.

In accordance with a further feature of the invention, the shade ring is a tubular segment.

In accordance with an added feature of the invention, the shade ring has a tube axis and a wall with a system of transverse slits formed therein in pairs one above the other, the slits defining respective wall surface portions between two transverse slits extending one above the other, inclined relative to the tube axis and each forming one sector of a conical jacket segment.

In accordance with an additional feature of the invention, the shade ring has a wall of ruffled sheet metal with a bottom and ruffled edges oriented outward toward the bottom.

In accordance with yet another feature of the invention, the bulb cover has a shoulder region below the domelike bulge, the heat shield body is a funnel-shaped molded part of sheet metal with an upper edge, and there are provided struts disposed on the upper edge, pointing downward from the upper edge and having radially bent ends in the shoulder region, for securing the heat shield body.

In accordance with yet a further feature of the invention, the bulb cover has a wall, the lamp canopy has a peripheral region, and there are provided screws inserted from outside through bores formed in the peripheral region of the lamp canopy, in the shoulder region of the bulb cover and in the ends of the struts, nuts on the screws for securing the heat shield body, and disks of heat-insulating material disposed between the struts and the wall of the bulb cover.

In accordance with yet an added feature of the invention, the lamp socket has an upper edge with another component of the bayonet mount interacting with the one component at the lower edge of the bulb cover, for detachably securing the bulb cover to the lamp socket.

In accordance with yet an additional feature of the invention, the bulb cover has a bottom reduced to a short peripheral portion with a reduced diameter, the short peripheral portion has circular-sector-shaped flange portions with tops each forming a steep plane rising in the same direction, the flange portions define gaps each disposed between a respective two of the flange portions; and the lamp socket has a top with a cylindrical outer edge having an inner surface with cams spanning the gaps between the flange portions of the transparent bulb cover, as a mating part of the bayonet mount.

In accordance with again another feature of the invention, the shade ring has a plurality of annular segments.

In accordance with a concomitant feature of the invention, the annular segments have openings formed therein.

Other features which are considered as characteristic for the invention are set forth in the appended claims.

Although the invention is illustrated and described herein as embodied in a lampshade for an outdoor light, especially a pole-mounted light, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4 is an enlarged, cross-sectional view taken along a line IV—IV of FIG. 1, in the direction of the arrows; and FIG. 5 is an enlarged, fragmentary, top-plan view of a central region of the lampshade.

DESCRIPTION OF THE PREFERRED EMBODIMENTS

Figure 1:
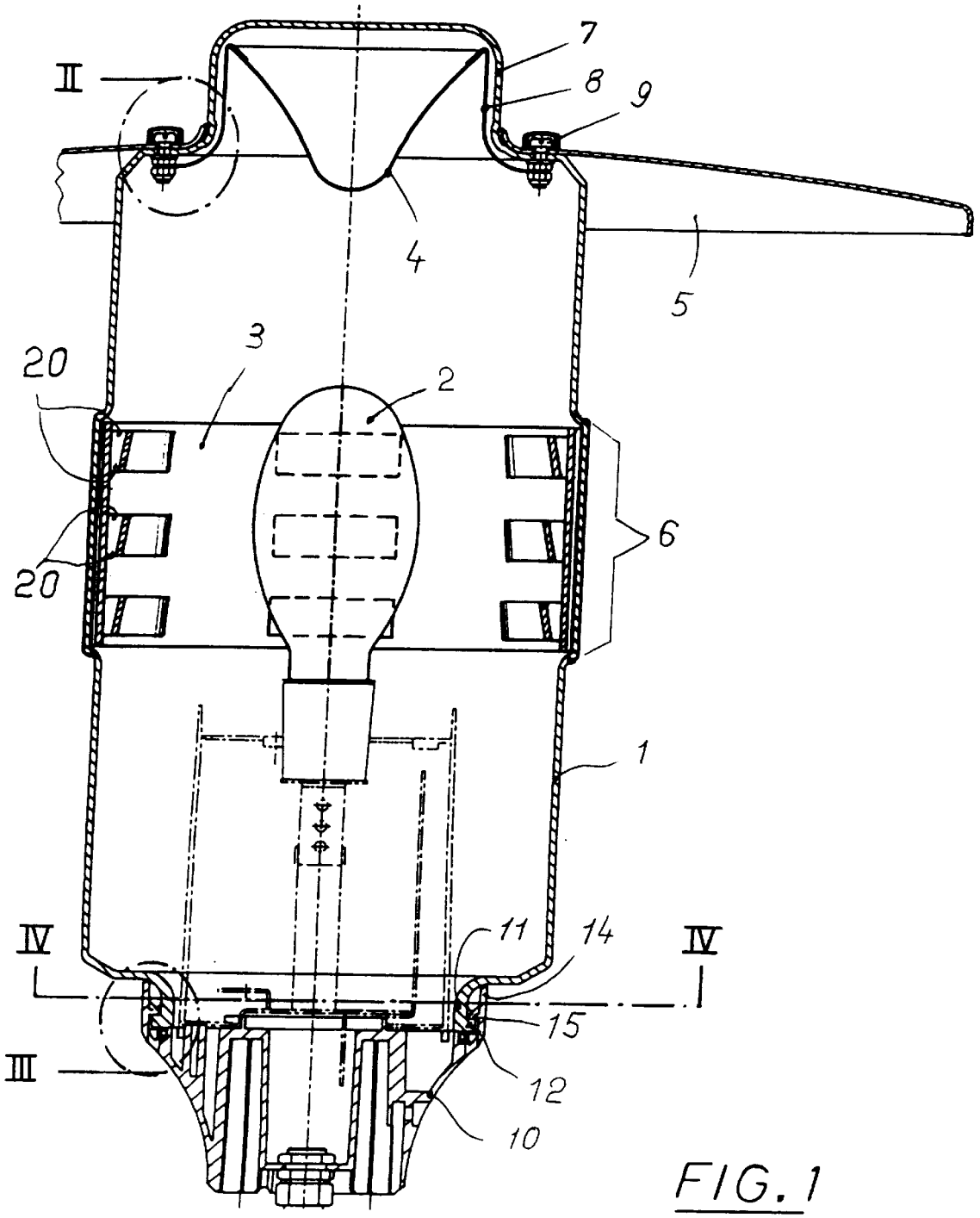
FIG. 1 is a fragmentary, diagrammatic, axial-sectional view of a post-mounted light with a lampshade according to the invention.

Referring now to the figures of the drawings in detail and first, particularly, to FIG. 1 thereof, there is seen a lampshade according to the invention which is substantially formed of a transparent bulb cover 1 of a thermoplastic synthetic that is constructed as a one-piece hollow body which is closed at the top, a shade ring 3 disposed in the bulb cover 1 at the level of a bulb 2, a heat shield body 4 disposed above the bulb 2 in the bulb cover 1 and a lamp canopy 5 disposed on an upper region of the bulb cover 1.

In the illustrated exemplary embodiment, the bulb cover 1 is a substantially cylindrical hollow body made of a polycarbonate. The bulb cover 1 has an enlargement 6 of its cross section in the form of a wide annular groove at the level of the bulb 2. The shade ring 3 is retained in the enlargement 6 and rests on an inner wall surface of the transparent bulb cover 1. The shade ring 3 is formed of sheet metal. In this exemplary embodiment, the shade ring 3 takes the form of a simple smooth cylinder, for the sake of simpler illustration. At least one edge of the shade ring 3 may be angled outward, so that the sheet metal heated by the bulb 2 does not touch the inner wall surface of the bulb cover with its entire surface area but rather only with narrow zones. However, the shade ring 3 may also be further constructed in such a way that its wall has a system of slits 20 which are offset from one another in pairs in annular lines. Wall surfaces located between each two slits disposed one above the other are inclined relative to a cylinder axis and thus form a circular sector of a conical jacket segment.

The shade ring 3 may, for instance, be in the form of ruffled sheet metal with ruffled edges pointing outward at the bottom. The advantage of these two last-mentioned features is that with the choice of inclination of the wall portions of the shade ring 3 that is possible because of the slit 20 system, an optimum between the broadest possible illumination of the ground on one hand and shading of horizontal light radiation on the other hand, can be selected.

Figure 2:
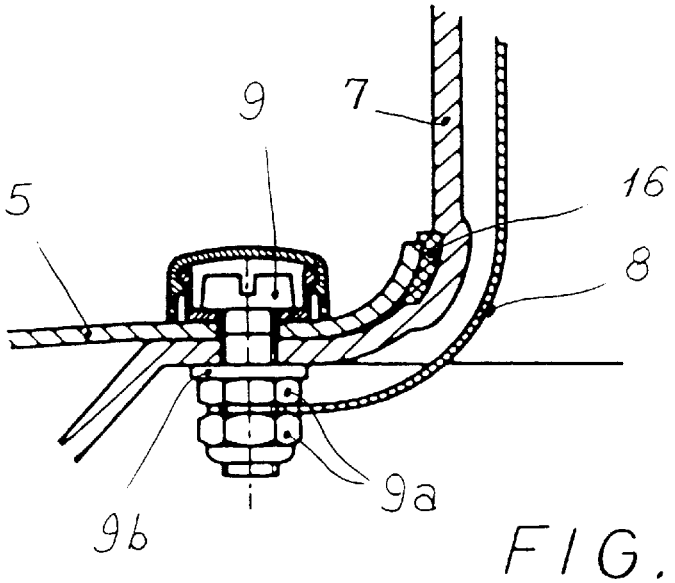
FIG. 2 is an enlarged, fragmentary view of portion II of FIG. 1.

The bulb cover 1 has a central domelike bulge 7 at the top, which protrudes out of a central opening in the lamp canopy 5. The heat shield body 4 is disposed in the bulge 7. The heat shield body 4 is constructed as a funnel-like molded part of sheet metal and is secured to the bulb cover 1 while being spaced apart from the inner wall surface of the bulb cover 1, through the use of struts 8 that are disposed on its upper edge, oriented downward from there and bent radially at its ends. Screws 9 are provided as securing devices and are inserted from outside through an inner peripheral region of the lamp canopy 5, a shoulder region of the bulb cover 1 and bores in the ends of the struts 8. As is seen in FIG. 2, a disk **9*b* of heat-insulating material is mounted on the screw 9 between the wall of the bulb cover 1 and two screw nuts 9*a*** that retain the end of the strut.

Figure 3:
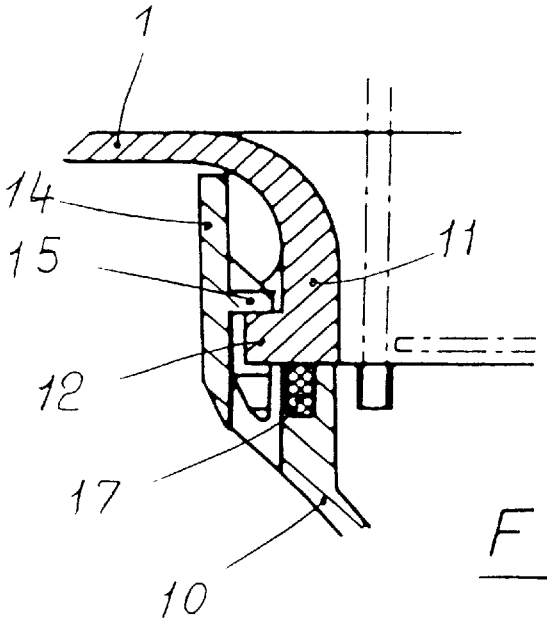
FIG. 3 is an enlarged, fragmentary view of portion III of FIG. 1.

The bulb cover 1 is secured to a lamp socket 10 through the use of a bayonet mount. To that end, as is best seen in FIG. 3, the bulb cover 1 is reduced at the bottom to a short peripheral portion 11 of reduced diameter and has circular-sector-shaped flange portions 12 with tops that each form a steep plane rising in the same direction. A gap 13 is provided between each two adjacent flange portions 12, as is seen in FIG. 4. The lamp socket 10 is provided at the top with a mating part of the bayonet mount in the form of a cylindrical outer edge 14. Cams or toes 15 are disposed on the inside of the outer edge 14 at the intervals of the gaps 13 between the flange portions 12 of the transparent bulb cover. When the mounted bulb cover 1 is rotated, these cams 15 fit over the flange portions 12 of the bulb cover 1 and firmly hold the bulb cover 1 on the lamp socket 10 with a wedging and clamping action.

The invention is not limited to the exemplary embodiment described above and shown in the drawings and the alternative forms of the shade ring that were mentioned. For instance, the bulb cover 1 and the lamp canopy 5 in particular may take other forms.

An annular groove which is provided at the base of the domelike bulge 7 of the bulb cover 1 has a sealing ring 16 fitting under an inner edge of the lamp canopy 5 to protect against the penetration of water. A further sealing ring 17 is disposed below the lower edge of the bulb cover 1 in an annular groove of the lamp socket 10.

I claim:

1. In a street light, outdoor light or the like mounted on a tubular pole or similar vertical holder and having a lamp socket and a bulb, a lampshade to be detachably connected to the lamp socket, comprising:

a plastic transparent bulb cover for surrounding the bulb at a given height, said bulb cover having a sharply offset zone with a cross-sectional enlargement at said given height, an upper end with a domelike bulge, and a lower edge with one component of a bayonet mount for connection to the lamp socket;

a sheet-metal shade ring disposed inside said bulb cover at said given height and nondisplaceably fixed in axial direction in said enlargement;

a lamp canopy disposed above the bulb outside said bulb cover, said lamp canopy having a central opening through which said domelike bulge protrudes and beyond which said domelike bulge extends; and a funnel-shaped metal heat shield body disposed inside said domelike bulge and spaced apart from said bulb cover.

2. The lampshade according to claim 1, wherein said bulb cover is a cylindrical hollow body, said shade ring is at a height, and said cross-sectional enlargement at said given height is a flat annular groove corresponding to said height and receiving said shade ring.

3. The lampshade according to claim 1, wherein said shade ring is a tubular segment.

4. The lampshade according to claim 2, wherein said shade ring has a tube axis and a wall with a system of transverse slits formed therein in pairs one above the other, said slits defining respective wall surface portions between two transverse slits extending one above the other, inclined relative to the tube axis and each forming one sector of a conical jacket segment.

5. The lampshade according to claim 1, wherein said shade ring has a wall of ruffled sheet metal with a bottom and ruffled edges oriented outward toward said bottom.

6. The lampshade according to claim 1, wherein said bulb cover has a shoulder region below said domelike bulge, said heat shield body is a funnel-shaped molded part of sheet metal with an upper edge, and including struts disposed on said upper edge, pointing downward from said upper edge and having radially bent ends in said shoulder region, for securing said heat shield body.

7. The lampshade according to claim 6, wherein said bulb cover has a wall, said lamp canopy has a peripheral region, and including screws inserted from outside through bores formed in said peripheral region of said lamp canopy, in said shoulder region of said bulb cover and in said ends of said struts, nuts on said screws for securing said heat shield body, and disks of heat-insulating material disposed between said struts and said wall of said bulb cover.

8. The lampshade according to claim 1, wherein the lamp socket has an upper edge with another component of said bayonet mount interacting with said one component at said lower edge of said bulb cover, for detachably securing said bulb cover to the lamp socket.

9. The lampshade according to claim 1, wherein:

said bulb cover has a bottom reduced to a short peripheral portion with a reduced diameter, said short peripheral portion has circular-sector-shaped flange portions with tops each forming a steep plane rising in the same direction, said flange portions define gaps each disposed between a respective two of said flange portions; and the lamp socket has a top with a cylindrical outer edge having an inner surface with cams spanning said gaps between said flange portions of said transparent bulb cover, as a mating part of said bayonet mount.

10. The lampshade according to claim 1, wherein said shade ring has a plurality of annular segments.

11. The lampshade according to claim 10, wherein said annular segments have openings formed therein.

* * * * *